US012134860B2

(12) United States Patent
Barriere

(10) Patent No.: US 12,134,860 B2
(45) Date of Patent: Nov. 5, 2024

(54) METHOD FOR MANUFACTURING PAPER AND CARDBOARD

(71) Applicant: SNF Group, Andrezieux Boutheon (FR)

(72) Inventor: Cyril Barriere, Andrezieux Boutheon (FR)

(73) Assignee: SNF GROUP, Andrezieux Boutheon (FR)

( * ) Notice: Subject to any disclaimer, the term of this patent is extended or adjusted under 35 U.S.C. 154(b) by 0 days.

(21) Appl. No.: 18/691,353

(22) PCT Filed: Sep. 21, 2022

(86) PCT No.: PCT/EP2022/076265

§ 371 (c)(1),
(2) Date: Mar. 12, 2024

(87) PCT Pub. No.: WO2023/046774

PCT Pub. Date: Mar. 30, 2023

(65) Prior Publication Data

US 2024/0263398 A1 Aug. 8, 2024

(30) Foreign Application Priority Data

Sep. 27, 2021 (FR) ..... 2110164

(51) Int. Cl.
*D21H 17/46* (2006.01)
*D21H 23/18* (2006.01)

(52) U.S. Cl.
CPC ..... *D21H 17/46* (2013.01); *D21H 23/18* (2013.01)

(58) Field of Classification Search
CPC ..... D21H 11/18; D21H 21/10; D21H 11/20; D21H 17/375; D21H 23/04; D21H 17/37; D21H 17/45; D21H 17/46; D21H 23/18; C08F 220/56; C08F 120/56
See application file for complete search history.

(56) References Cited

U.S. PATENT DOCUMENTS

2015/0041089 A1 2/2015 Castro et al.
2015/0176208 A1* 6/2015 Hund ..... D21F 1/82 162/164.2
2024/0044082 A1* 2/2024 Barriere ..... D21H 21/10
2024/0200270 A1* 6/2024 Barriere ..... C08F 120/56
2024/0263398 A1* 8/2024 Barriere ..... D21H 23/18

FOREIGN PATENT DOCUMENTS

AU 2022353080 A1 * 3/2024 ..... D21H 11/18
CA 3231577 A1 * 3/2023 ..... D21H 11/18
CN 117980560 A * 5/2024 ..... D21H 11/18
EP 4185749 B1 * 11/2023 ..... D21H 11/18
FR 2963364 A1 2/2013
FR 3118072 A1 * 6/2022 ..... C08F 220/56
FR 3127507 A1 * 3/2023 ..... D21H 11/18
WO WO-2022136794 A1 * 6/2022 ..... C08F 220/56

OTHER PUBLICATIONS

International Search Report and Written Opinion of International Application No. PCT/EP2022/076265, mailed on Jan. 27, 2023, 9 pages.

* cited by examiner

*Primary Examiner* — Jose A Fortuna
(74) *Attorney, Agent, or Firm* — Heslin Rothenberg Farley & Mesiti P.C.

(57) ABSTRACT

This invention relates to a process for making a paper or cardboard sheet from a fibrous suspension, comprising the following steps:

a) injecting a P3 polymer into a suspension of cellulosic fibers,
b) forming a paper or cardboard sheet,
c) drying the paper or cardboard sheet, the P3 polymer being prepared, prior to step a), from a water-soluble P1 polymer of at least one nonionic monomer selected from acrylamide, methacrylamide, N,N-dimethylacrylamide and acrylonitrile, the P1 polymer being subjected to an Re1 reaction to give a P2 polymer, which is then subjected to an Re2 reaction to give the P3 polymer, which is injected into the fibrous suspension within 24 hours of the start of the Re1 reaction, the Re1 reaction comprises preparing a P2 polymer comprising isocyanate functions by reaction for 10 seconds to 60 minutes between (i) an alkali hydroxide and/or an alkaline earth hydroxide, (ii) an alkali hypohalite and/or an alkaline earth hypohalite and (iii) the P1 polymer, the Re2 reaction comprises preparing a P3 polymer by reaction between (iv) a micro-cellulose compound and (v) the P2 polymer comprising isocyanate functions.

20 Claims, No Drawings

METHOD FOR MANUFACTURING PAPER AND CARDBOARD

CROSS REFERENCE TO RELATED APPLICATIONS

This application is a national stage filing under section 371 of International Application No. PCT/EP2022/076265, filed on Sep. 21, 2022, and published on Mar. 30, 2023 as WO 2023/046774 A1, which claims priority to French Application No. 2110164, filed on Sep. 27, 2021. The entire contents of WO 2023/046774 A1 are hereby incorporated by reference herein.

FIELD OF THE INVENTION

This invention relates to a process for the manufacture of paper or board having improved drainage and machinability properties. More specifically, the subject-matter of the invention is a process involving the preparation of a polymer resulting from functionalization by isocyanates and the addition of micro-cellulose compounds before its addition to the fibrous suspension used to manufacture the paper or the cardboard.

This invention also has for its subject-matter papers and cardboard with improved physical properties obtained by this process.

PRIOR ART

The paper industry is constantly seeking to optimize its manufacturing processes, particularly in terms of yield, productivity, cost reduction, and quality of finished products.

The use of polymers as dry strength, drainability, and machinability agents is widely described.

The dewatering properties (or drainage) relate to the ability of the fibrous mat to evacuate or drain the maximum amount of water before drying. Improved drainage properties mean energy savings and increased production capacity.

Machinability means optimizing the operation of the paper machine by increasing productivity through better drainage on the table, better dryness at the press section, a reduction in breakage through greater circuit cleanliness and a reduction in deposits.

US 2015/041089 discloses polymer grafted nanocrystalline cellulose that improves the wet strength, dry strength and drainage retention properties of paper substrates. The synthesis of this polymer grafted nanocrystalline cellulose does not involve the formation of isocyanate bonds; it involves polymerizing monomers in the presence of nanocrystalline cellulose (5-10 nm diameter and 100-500 nm length). As clearly specified in paragraphs and of US 2015/041089, the drainage retention refers to the retention of solids during the drainage of liquid medium from the paper substrate, more specifically small solids such as fines, fillers or nanocrystalline cellulose. This is evidenced by the reduction of the turbidity. According to the examples of US 2015/041089, the nanocrystalline cellulose represents approximately 4% by weight of the polymer. US 2015/041089 does not seek to improve the dewatering properties in a papermaking process.

Micro-cellulose compounds are known to improve the physical properties of paper when added to the pulp (metering around 1-2% by weight). However, they have a negative impact on drainage i.e. on the dewatering properties.

Micro-cellulose compounds are generally in the form of pulp (containing 3% by weight of fiber) and have thickening properties. Their direct incorporation into polymer solutions such as polyvinylamines at their place of manufacture is therefore not logistically viable.

DISCLOSURE OF THE INVENTION

Unexpectedly, the Applicant has discovered that a paper process using a polymer resulting, just upstream of its injection into a fibrous suspension (advantageously a suspension of cellulosic fibers), from a functionalization with isocyanates and the addition of micro-cellulose compounds which allows an improvement in the drainage and dry strength properties, while having low metering (low dosage) of micro-cellulose in relation to the pulp.

More precisely, the invention relates to a process for making a paper or cardboard sheet from a fibrous suspension (advantageously a suspension of cellulosic fibers), during which a water-soluble polymer P1 comprising at least one nonionic monomer selected from acrylamide methacrylamide, N,N-dimethylacrylamide and acrylonitrile is subjected to a reaction Re1 to give a polymer P2, which is then subjected to a reaction Re2 to give a polymer P3, which is injected into the fibrous suspension within 24 hours from the start of the reaction Re1,

- The reaction Re1 comprises adding an alkali and/or alkaline earth hydroxide and an alkali and/or alkaline earth hypohalite to polymer P1 to obtain the isocyanate-functionalized polymer P2 after 10 seconds to 60 minutes,
- The reaction Re2 comprises preparing a polymer P3 by reaction between a micro-cellulose compound and the P2 polymer comprising isocyanate functions.

In other words, the process for manufacturing a sheet of paper or cardboard from a fibrous suspension, according to the invention, comprises the following steps:

a) injection of a polymer P3 into a fibrous suspension (advantageously a suspension of cellulosic fibers),
b) formation of a sheet of paper or cardboard,
c) drying the sheet of paper or cardboard, preparing polymer P3, prior to step a), according to reactions Re1 to Re2, from a water-soluble polymer P1 of at least one nonionic monomer selected from acrylamide, methacrylamide, N,N-dimethylacrylamide, and acrylonitrile:

- reaction Re1: preparation of a polymer P2 comprising isocyanate functions by reaction for 10 seconds to 60 minutes between (i) an alkali hydroxide and/or an alkaline earth hydroxide, (ii) an alkaline hypo-halide and/or an alkaline-earth hypo-halide, and (iii) polymer P1,
- reaction Re2: preparing a polymer P3 by reaction between (iv) a micro-cellulose compound and (v) polymer P2 comprising isocyanate functions.

This process is preferably free of any decarboxylation step after reaction Re1 and before reaction Re2. A decarboxylation step after reaction Re1 and before reaction Re2 would actually reduce the number of isocyanate functions that could react with the micro-cellulose. This process can also be free of any decarboxylation step after reaction Re2, even when isocyanate functions remain on polymer P3.

In the following description and in the claims, all polymer metering expressed in $g \cdot t^{-1}$ or $kg \cdot t^{-1}$ is given in weight of polymer per ton of dry matter. The dry matter corresponds to the dry extract obtained after evaporation of the water from the fibrous suspension used in a process for manufacturing a sheet of paper or cardboard. The dry matter advantageously consists of cellulosic fibers and fillers. The dry matter does not include the micro-cellulose compound of the P3 polymer. The term "cellulosic fibers" encompasses any cellulosic entity, including fibers, fines, microfibrils or nanofibrils. By fibrous suspension, we mean the thick stock or the diluted pulp which is based on water and cellulosic fibers. Thick stock, having a mass concentration of dry matter generally greater than 1%, even higher than 3%, is upstream of the mixing pump (fan-pump). Thin Stock having a mass concentration of dry matter generally lower than 1%, is located downstream of the fan pump.

The term "polymer" denotes both homopolymers and copolymers of at least two distinct monomers.

An amphoteric polymer is a polymer comprising cationic charges and anionic charges, preferably as many anionic charges as cationic charges.

As used herein, the term "water-soluble polymer" means a polymer that yields an aqueous solution without insoluble particles when dissolved with stirring for 4 hours at 25° C. and with a concentration of 20 $g \cdot L^{-1}$ in deionized water.

Value ranges include lower and upper bounds. Thus, the ranges of values "between 0.1 and 1.0" and "from 0.1 to 1" include the values 0.1 and 1.0.

The water-soluble polymer P1 is a polymer of at least one nonionic monomer selected from acrylamide, methacrylamide, N,N-dimethylacrylamide, and acrylonitrile. Preferably, polymer P1 contains at least 50 mol % of at least one of these nonionic monomers.

Water-soluble polymer P1 can be prepared by any conventional polymerization technique, for instance by solution polymerization, gel polymerization, emulsion polymerization (water in oil or oil in water). In general, water-soluble polymer P1 is prepared at a temperature that is preferably greater than that of reaction Re1 and/or greater than that of reaction Re2.

Polymer P1 can also contain anionic monomers and/or cationic monomers and/or zwitterionics monomers. Polymer P1 is advantageously free of any nonionic monomer which is not selected from acrylamide, methacrylamide, N,N-dimethylacrylamide, and acrylonitrile.

The anionic monomers are preferably selected from the group comprising monomers having a carboxylic acid function and salts thereof, including acrylic acid, methacrylic acid, itaconic acid, maleic acid, monomers having a sulfonic acid function and salts thereof, including acrylamide tertiary-butyl sulfonic acid (ATBS), allyl sulfonic acid and methallyl sulfonic acid, and salts thereof; and monomers having a phosphonic acid function and salts thereof.

In general, the salts of anionic monomers of polymer P1 are salts of an alkali metal, an alkaline-earth metal, or an ammonium (preferably a quaternary ammonium).

Preferred monomers belonging to this class are, e.g., quaternized dimethylaminoethyl acrylate (DMAEA), quaternized dimethylaminoethyl methacrylate (DEAEMA), dimethyldiallylammonium chloride (DADMAC), acrylamido propyltrimethyl ammonium chloride (APTAC), and methacrylamido propyltrimethyl ammonium chloride (MAPTAC), and mixtures thereof.

Advantageously, the cationic monomers of polymer P1 have a halide as a counterion, preferably a chloride ion.

The zwitterionic monomers are preferably selected from the group comprising sulfobetaine monomers such as sulfopropyl dimethylammonium ethyl methacrylate, sulfopropyl dimethylammonium propyl methacrylamide, or sulfopropyl 2-vinylpyridinium; phosphobetaine monomers, such as phosphato ethyltrimethylammonium ethyl methacrylate; and carboxybetaine monomers.

Preferably, water-soluble polymer P1 is nonionic. In other words, it preferably only comprises nonionic monomers. Even more preferably, water-soluble polymer P1 is an acrylamide or methacrylamide homopolymer.

Polymer P1 may be linear, structured or cross-linked. In particular, the cross-linking agents that make structuring possible may be selected from sodium allyl sulfonate, sodium methallyl sulfonate, sodium methallyl disulfonate, methylenebisacrylamide, triallylamine, and triallylammonium chloride.

The structuring of polymer P1 can also be obtained with at least one polyfunctional compound containing at least 3 heteroatoms selected from N, S, O, P and each having at least one mobile hydrogen. This polyfunctional compound can in particular be a polyethyleneimine or a polyamine.

Polymer P1 has a weight-average molecular weight advantageously between 100,000 and 20 million Daltons, preferably between 250,000 and 5 million Daltons.

According to this invention, the weight-average molecular weight of polymer P1 is determined by measuring the intrinsic viscosity. Intrinsic viscosity may be measured by methods known to those skilled in the art and may in particular be calculated from the values of reduced viscosity for different concentrations by a graphical method consisting in plotting the values of reduced viscosity (on the ordinate axis) as a function of the concentrations (on the abscissa axis) and by extrapolating the curve to a zero concentration. The intrinsic viscosity value is read on the ordinate axis or using the least squares method. Then the weight average molecular weight can be determined by the famous Mark-Houwink equation:

$$[\eta]=KM^{\alpha}$$

$[\eta]$ represents the intrinsic viscosity of the polymer determined by the solution viscosity measurement method, K represents an empirical constant, M represents the molecular weight of the polymer, $\alpha$ represents the Mark-Houwink coefficient, $\alpha$ and K depend on the particular polymer-solvent system. Tables known to those skilled in the art give the values of a and K according to the polymer-solvent system.

The Re1 reaction consists of adding (i) an alkali hydroxide and/or an alkaline earth hydroxide and (ii) an alkaline hypo-halide and/or an alkaline-earth hypo-halide (iii) to polymer P1 in order to obtain the polymer P2 functionalized with isocyanates.

Advantageously, the alkali hydroxide is soda (sodium hydroxide) and the alkali hypo-halide is sodium hypochlorite.

Reaction Re1 is advantageously carried out on polymer P1 at a mass concentration of polymer P1 of between 0.5 and 20% in aqueous solution, preferably between 1 and 10%.

Preferably, for the Re1 reaction, the Alpha coefficient=moles of hypo-halide (alkaline and/or alkaline earth)/moles of nonionic monomer(s) of polymer P1 is between 0.1 and 1.0 and the coefficient Beta=moles of hydroxide (alkaline and/or alkaline earth)/moles of hypo-halide (alkaline and/or alkaline earth) is between 0.5 and 4.0.

The Alpha coefficient makes it possible to determine the quantity of isocyanate functions formed during the reaction Re1 from the nonionic monomers of polymer P1 (acrylamide, methacrylamide, N,N-dimethylacrylamide and acrylonitrile). Here, the Alpha coefficient is not the $\alpha$ coefficient of the Mark-Houwink equation.

The Re1 reaction is advantageously carried out at a temperature between 30° C. and 60° C., more advantageously at a temperature between 40° C. and 50° C.

Thus, according to one particular embodiment, the Re1 reaction may be carried out from an aqueous solution having a mass concentration of polymer P1 of between 0.5 and 20%, at a temperature between 30° C. and 60° C. and in the presence of an Alpha coefficient between 0.1 and 1.0, the Alpha coefficient being the ratio between the number of hypo-halide moles and the number of nonionic monomer moles of polymer P1.

The Re2 reaction consists of preparing a polymer P3 by reaction between a micro-cellulose compound and polymer P2 comprising isocyanate functions.

Advantageously, during the Re2 reaction, the micro-cellulose compound is in the form of a suspension in water.

The Re2 reaction is advantageously carried out on polymer P2 at a mass concentration of polymer P2 of between 0.5 and 20% in aqueous solution, preferably between 1 and 5%.

Advantageously, the Re2 reaction is carried out in the absence of compounds having at least one aldehyde function or compounds capable of generating at least one aldehyde function.

The Re2 reaction preferably takes place by direct addition of the micro-cellulose compound to the reaction medium (aqueous solution) resulting from the Re1 reaction.

Polymer P3 is injected into the fibrous suspension within 24 hours from the start of reaction Re1. Indeed, the isocyanate groups that are formed during reaction Re1 are very reactive and unstable short-lived species. An overall reaction time over 24 hours would reduce (eventually to zero) the amount of isocyanate functions readily available to react with the micro-cellulose.

The Re2 reaction is advantageously carried out at a temperature between 10° ° C. and 60° C., preferably between 20 and 40° C.

Without wishing to be limited by any theory, it would seem that, during the Re2 reaction, the isocyanate functions of polymer P2 react with the OH functions of the micro-cellulose compound, for example in order to form the carbamate functions of the —NH—C(═O)—O. The Re2 reaction does not require any pre-treatment of the micro-cellulose.

The invention allows functionalizing a polymer with a pre-defined amount of micro-cellulose, thanks to the control of isocyanate functions that are formed. This is opposite to US 2015/041089, which allows functionalizing nanocrystalline cellulose, with a pre-defined amount of polymer chains since it requires pre-functionalizing the nanocrystalline cellulose with reactive groups.

Accordingly, the invention provides a convenient way of functionalizing polymers with micro-cellulose since the process can be carried out by the papermaker, directly in the papermaking plant. The invention allows to control, prior to reaction Re1, the formation of polymer P1 (monomers, molecular weight, structure), which would not be possible if polymer P1 were prepared in the presence of cellulose.

Preferably, the micro-cellulose compound is selected from nano-fibrillated cellulose, micro-fibrillated cellulose, nano-crystalline cellulose, nano-cellulose.

Preferably for the Re2 reaction, between 10% and 100% of micro-cellulose compound are added to polymer P2, % by weight relative to the weight of polymer P2, more preferably between 10 and 50%.

According to a preferred embodiment, polymer P3 is introduced into the white water and/or the thick stock and/or the mixture formed by the white water and the thick stock after homogenization of the fibrous suspension in the fan pump.

Advantageously, polymer P3 can also be introduced into the papermaking process at the level of the forming table, for example by spraying or in the form of a foam, or at the level of the size press.

Advantageously, between 0.1 and 10 $kg \cdot t^{-1}$, and preferably between 0.2 and 5.0 $kg \cdot t^{-1}$ of polymer P3 are added to the fibrous suspension.

Polymer P3 is preferably introduced into the papermaking process immediately after reaction Re2, preferably without any purification step.

The fibrous suspension encompasses the possible use of different cellulosic fibers: virgin fibers, recycled fibers, chemical pulp, mechanical pulp. The fibrous suspension also includes the use of these different cellulosic fibers with all types of fillers such as $TiO_2$, $CaCO_3$ (ground or precipitated), kaolin, organic fillers and mixtures thereof.

Polymer P3 may be used within the papermaking process in combination with other products such as inorganic or organic coagulants, dry strength agents, wet strength agents, natural polymers such as starches or carboxymethylcellulose (CMC), inorganic microparticles such as bentonite microparticles and colloidal silica microparticles, organic polymers of any ionic nature (nonionic, cationic, anionic, or amphoteric), and which can be (without being limiting) linear, branched, cross-linked, hydrophobic, or associative.

The following examples illustrate the invention without limiting its scope.

EXAMPLES OF EMBODIMENTS OF THE INVENTION

Procedures Used in Application Testing:

a) Types of Pulps Used

Recycled Fiber Pulp:

Wet pulp is obtained by disintegrating dry pulp to obtain a final aqueous concentration of 1% by weight. It is a pH-neutral pulp made from 100% recycled cardboard fibers.

b) Evaluation of the Drainage Performance (DDA)

The DDA ("Dynamic Drainage Analyzer") makes it possible to automatically determine the time (in seconds) required to drain a fibrous suspension under vacuum. The polymers are added to the wet pulp (0.6 liters of pulp at 1.0% by weight) in the DDA cylinder with stirring at 1000 rpm:

T=0s: pulp stirring

T=20s: Add the additive

T=30s: stop stirring and drain under vacuum at 200 mbar (1 bar=$10^5$ Pa) for 70 s.

The pressure under the sheet is recorded as a function of time. When all the water is evacuated from the fibrous mat, the air passes through it causing a break in the slope to appear on the curve representing the pressure under the sheet as a function of time. The time, expressed in seconds, recorded at this break in slope corresponds to the drainage time. The shorter the time, the better the vacuum drainage.

c) Performance in the DSR Application (Dry Strength), Weight at 90 $gm^{-2}$

The necessary amount of pulp is removed so as to obtain a sheet having a basis weight of 90 $gm^{-2}$.

The wet pulp is introduced into the vat of the dynamic molder and is kept under agitation. The different components of the system are injected into this pulp according to the predefined sequence. A contact time of 30 to 45 seconds is generally observed between each addition of polymer.

Paper formers are made with an automatic dynamic former: a blotter and the forming sheet are placed in the bowl of the dynamic former before starting the rotation of the bowl at 1000 $rpm^{-1}$ and building the water wall. The treated pulp is spread over the water wall to form the fibrous mat on the forming sheet.

Once the water is drained, the fibrous mat is recovered, pressed under a press delivering 4 bar, then dried at 117° C. The sheet obtained is conditioned overnight in a room with controlled humidity and temperature (50% relative humidity and 23° C.). The dry strength properties of all the sheets obtained by this procedure are then measured.

The burst is measured with a Messmer Buchel M 405 burst meter according to TAPPI T403 om-02. The result is expressed in kPa. The bursting index, expressed in $kPa \cdot m^2/g$, is determined by dividing this value by the weight of the sheet tested.

Products Tested in Application Trials:

P1 Polymers 310 g of water are introduced into a 1 liter reactor equipped with a mechanical stirrer, a thermometer, a condenser, and a nitrogen gas plunger. The pH of the reaction medium is adjusted to 3.3 using a pH buffer (30% NaOH and $H_3PO_4$ 75%). The medium is heated and maintained at a temperature of between 79 and 81° C. using a water bath. By means of two continuous castings, 400 g of 50% acrylamide, 0.28 g of 100% N,N-methylene-bis-acrylamide, 237.8 g of water, and 2.40 g of 100% sodium methallyl sulfonate are incorporated (casting 1) for 180 minutes. Casting 2, 0.48 g of 100% sodium persulfate and 48 g of water for 180 minutes. The polymer is left at 80° C. for 120 minutes after the end of casting.

The P1 polymer obtained has a pH of 5.7, a concentration of 20% and a viscosity of 6000 cps.

P2 Polymers

Preparation of a 10% P1 solution, 20 g of P1 and 20 g of water. The polymer is heated to 50° C.

A mixture of 14.6% sodium hypochlorite and 30% sodium hydroxide is prepared with an alpha coefficient equal to 0.5 and a beta coefficient equal to 2 for the Re1 reaction. When polymer P1 is at 50° C., the mixture of sodium hypochlorite and sodium hydroxide is added to P1. After 30 seconds of reaction, water (room temperature) is added. The P2 polymer is obtained.

P3 Polymers

- 3 minutes after obtaining polymer P2, 17.7 g of micro-fibrillated cellulose (3% by weight in water at 30° C.) and 15 g of water (room temperature) are added to perform the Re2 reaction, i.e., 15% mass with respect to polymer P2. The P3-A polymer is obtained.
- 3 minutes after obtaining polymer P2, 41.3 g of micro-fibrillated cellulose (3% by weight in water at 30° C.) and 30 g of water (room temperature) are added to perform the Re2 reaction, i.e., 35% by weight of polymer P2. Polymer P3-B is obtained.
- 3 minutes after obtaining polymer P2, 4.7 g of micro-fibrillated cellulose (3% by weight in water at 30° C.) and 5 g of water (room temperature) are added to perform the Re2 reaction, i.e., 4% by weight of polymer P2. Polymer P3-C is obtained.

Application Tests:

Below, MFC means micro-fibrillated cellulose

TABLE 1

Drainage and dry strength depending on the measurements in micro-fibrillated cellulose or P3 polymers in the pulp.

| Sample | Drainage | Burst Index |
|---|---|---|
| Blank | 25 | 2.35 |
| P3-A (1.5 kg/t) | 18 | 2.9 |
| P3-B (1.5 kg/t) | 22 | 2.8 |
| P3-C 1.5 kg/t | 17 | 2.65 |
| MFC (0.150 kg/t) | 26 | 2.4 |
| MFC (0.350 kg/t) | 27 | 2.45 |
| MFC (20 kg/t) | 32 | 2.95 |

The addition of micro-fibrillated cellulose in the pulp causes a decrease in drainage. This is even more apparent with a micro-fibrillated cellulose measurement of 20 kg/t when this measurement gives the greatest improvement in bursting.

The process of the invention which consists in adding polymers P3-A, P3-B or P3-C to the pulp makes it possible to obtain equivalent results in terms of improved bursting, while allowing a marked improvement in drainage combined with a decrease in the consumption of micro-fibrillated cellulose. For P3-C, for which MFC weight % added for Re2 is below 10%, (by weight relative to the weight of polymer P2), the improvement in bursting is lower than for P3-A and P3-B.

The invention claimed is:

1. A process for manufacturing a paper or cardboard sheet from a fibrous suspension, comprising the following steps:

a) injecting a P3 polymer into a fibrous suspension, b) forming a paper or cardboard sheet, c) drying the paper or cardboard sheet, polymer P3 being prepared before step a) from a water-soluble polymer P1 of at least one nonionic monomer selected from acrylamide, methacrylamide, N,N-dimethylacrylamide, and acrylonitrile, polymer P1 being subjected to an Re1 reaction to give a polymer P2, which is then subjected to an Re2 reaction to give a P3 polymer, which is injected into the fibrous suspension within 24 hours from the start of the Re1 reaction, wherein the Re1 reaction comprises preparing a P2 polymer comprising isocyanate functions by reaction for 10 seconds to 60 minutes between (i) an alkali hydroxide and/or an alkaline earth hydroxide, (ii) an alkali metal hypohalite and/or an alkaline earth metal hypohalite, and (iii) the P1 polymer, wherein the Re2 reaction comprises preparing a P3 polymer by reaction between (iv) a micro-cellulose compound and (v) the P2 polymer comprising isocyanate functions.

2. The process according to claim 1, wherein polymer P1 is nonionic.

3. The process according to claim 2, wherein polymer P1 is a homopolymer of acrylamide or methacrylamide.

4. The process according to claim 3, wherein: for the Re1 reaction, a coefficient Alpha=moles of hypohalite/moles of nonionic monomer of the water-soluble P1 polymer is between 0.1 and 1.0 and a coefficient Beta=moles of hydroxide/moles of hypo-halide is between 0.5 and 4.0; and for the Re2 reaction, the micro-cellulose compound is selected from nano-fibrillated cellulose, micro-fibrillated cellulose, nano-crystalline cellulose, nano-cellulose.

5. The process according to claim 4, wherein, for the Re2 reaction, between 10% and 100% of micro-cellulose compound is added to polymer P2, % by weight relative to the weight of polymer P2.

6. The process according to claim 5, wherein polymer P3 is introduced into a white water and/or into a thick stock and/or into a mixture formed by the white water and the thick stock after homogenization of the fibrous suspension in a dilution pump.

7. The process according to claim 5, wherein:

the Re2 reaction is carried out in the absence of compounds having at least one aldehyde function or of compounds capable of generating at least one aldehyde function;

the Re1 reaction is carried out from an aqueous solution having a mass concentration of polymer P1 of between 0.5 and 20%, at a temperature between 30° C. and 60° C.;

the Re2 reaction is carried out in the presence of polymer P2 and from 10 to 50% of micro-cellulose compound, by weight relative to polymer P2, the process is free of any decarboxylation step after reaction Re1 and before reaction Re2;

the process is free of any decarboxylation step after reaction Re2; and between 0.1 and 10 kg of polymer P3 are added to the fibrous suspension, per ton of dry matter of the fibrous suspension, wherein the fibrous suspension is a suspension of cellulosic fibers and fillers in water.

8. The process according to claim 1, wherein polymer P1 is a homopolymer of acrylamide or methacrylamide.

9. The process according to claim 1, wherein, for the Re1 reaction, a coefficient Alpha=moles of hypohalite/moles of nonionic monomer of the water-soluble P1 polymer is between 0.1 and 1.0 and a coefficient Beta=moles of hydroxide/moles of hypo-halide is between 0.5 and 4.0.

10. The process according to claim 1, wherein, for the Re2 reaction, the micro-cellulose compound is selected from nano-fibrillated cellulose, micro-fibrillated cellulose, nano-crystalline cellulose, nano-cellulose.

11. The process according to claim 1, wherein, for the Re2 reaction, between 10% and 100% of micro-cellulose compound is added to polymer P2, % by weight relative to the weight of polymer P2.

12. The process according to claim 1, wherein polymer P3 is introduced into a white water and/or into a thick stock and/or into a mixture formed by the white water and the thick stock after homogenization of the fibrous suspension in a dilution pump.

13. The process according to claim 1, wherein during the Re2 reaction, the micro-cellulose compound is in the form of a suspension in water.

14. The process according to claim 1, wherein the Re2 reaction is carried out in the absence of compounds having at least one aldehyde function or of compounds capable of generating at least one aldehyde function.

15. The process according to claim 1, wherein the Re1 reaction is carried out from an aqueous solution having a mass concentration of polymer P1 of between 0.5 and 20%, at a temperature between 30° C. and 60° C. and in the presence of a coefficient Alpha=moles of hypohalite/moles of nonionic monomer of the water-soluble P1 polymer is between 0.1 and 1.0;

the Re2 reaction is carried out in the presence of polymer P2 and from 10 to 100% of micro-cellulose compound, by weight relative to polymer P2.

16. The process according to claim 1, wherein the process is free of any decarboxylation step after reaction Re1 and before reaction Re2.

17. The process according to claim 1, wherein the process is free of any decarboxylation step after reaction Re2.

18. The process according to claim 1, wherein, for the Re2 reaction, between 10% and 50% of micro-cellulose compound is added to polymer P2, % by weight relative to the weight of polymer P2.

19. The process according to claim 1, wherein between 0.1 and 10 kg of polymer P3 are added to the fibrous suspension, per ton of dry matter of the fibrous suspension, wherein the fibrous suspension is a suspension of cellulosic fibers and fillers in water.

20. The process according to claim 1, wherein:

for the Re1 reaction, a coefficient Alpha=moles of hypohalite/moles of nonionic monomer of the water-soluble P1 polymer is between 0.1 and 1.0 and a coefficient Beta moles of hydroxide/moles of hypo-halide is between 0.5 and 4.0, for the Re2 reaction, the micro-cellulose compound is selected from nano-fibrillated cellulose, micro-fibrillated cellulose, nano-crystalline cellulose, nano-cellulose, for the Re2 reaction, between 10% and 100% of micro-cellulose compound is added to polymer P2, % by weight relative to the weight of polymer P2, the Re1 reaction is carried out from an aqueous solution having a mass concentration of polymer P1 of between 0.5 and 20%, at a temperature between 30° C. and 60° C.

* * * * *